United States Patent [19]

Tong

[11] 4,150,789

[45] Apr. 24, 1979

[54] CONNECTION DEVICE FOR TOY VEHICLE TRACKS

[75] Inventor: Duncan Tong, Hong Kong, Hong Kong

[73] Assignee: Playart Limited, Hong Kong, Hong Kong

[21] Appl. No.: 852,634

[22] Filed: Nov. 18, 1977

Related U.S. Application Data

[63] Continuation-in-part of Ser. No. 807,102, Jul. 16, 1977, abandoned.

[30] Foreign Application Priority Data

Jul. 22, 1976 [GB] United Kingdom ..... 30661/76

[51] Int. Cl.[2] ..... A63H 19/30

[52] U.S. Cl. ..... 238/10 E; 46/1 K; 104/DIG. 1

[58] Field of Search ..... 238/10 R, 10 A–10 F; 104/53, 60, 147 A, DIG. 1; 46/1 K, 216; 273/86 R, 86 B

[56] References Cited

U.S. PATENT DOCUMENTS

| | | | |
|---|---|---|---|
| 1,142,150 | 6/1915 | Dorrill | 238/10 E |
| 2,764,357 | 9/1956 | Katryniak | 238/10 C |
| 3,288,368 | 11/1966 | Athearn | 238/10 F |
| 3,520,475 | 7/1970 | Ernst | 238/10 F |
| 3,581,988 | 6/1971 | Kin et al. | 238/10 E |
| 3,583,631 | 6/1971 | Christiansen | 238/10 E |

FOREIGN PATENT DOCUMENTS

| | | | |
|---|---|---|---|
| 2135202 | 2/1973 | Fed. Rep. of Germany | 238/10 E |
| 1182562 | 9/1957 | France | 238/10 E |
| 1255076 | 12/1961 | France | 238/10 E |
| 331666 | 7/1930 | United Kingdom | 238/10 R |

*Primary Examiner*—Robert G. Sheridan
*Assistant Examiner*—Ross Weaver
*Attorney, Agent, or Firm*—Townsend and Townsend

[57] ABSTRACT

A plurality of toy vehicle track sections, each having at one cr both ends of each track section, a protruding plug portion of plastics material and socket, the socket being adapted to receive a similar plug portion on the next track section, and the plug portion fitting into a similar socket on the next track section, the plug portion or socket having a detent, and the socket or plug portion correspondingly having a detent receiving means for locking engagement with the detent.

6 Claims, 5 Drawing Figures

Fig. 1
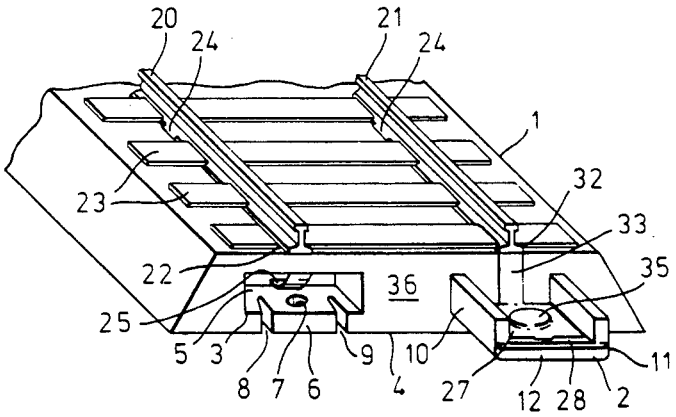
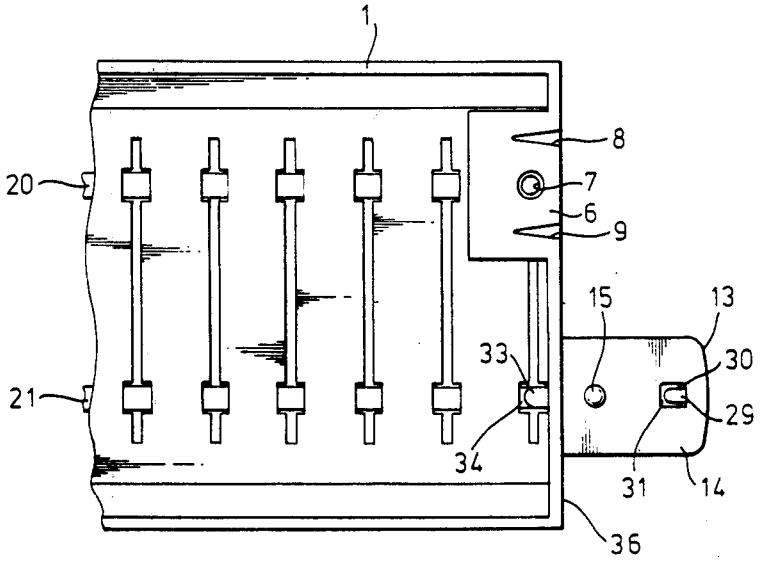
Fig. 2

FIG. 5.
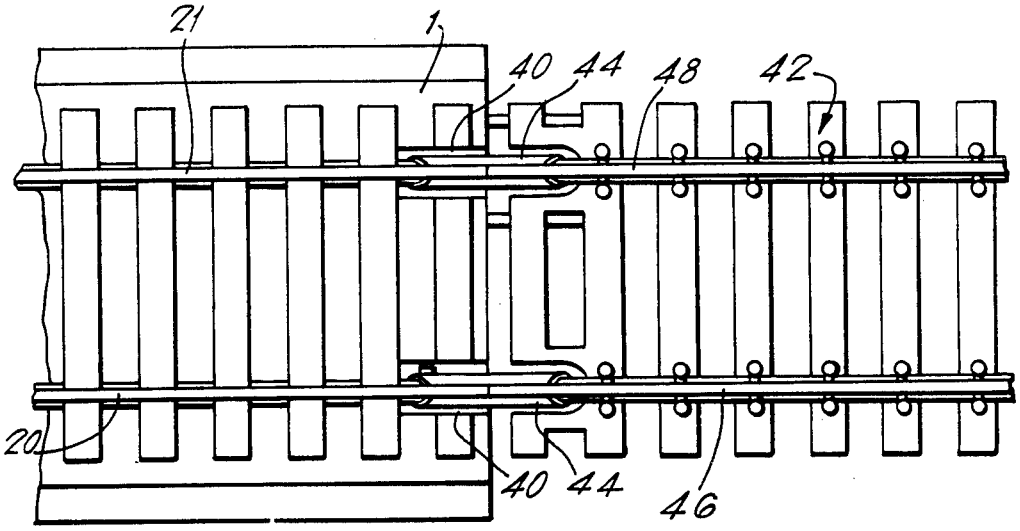
FIG. 3.
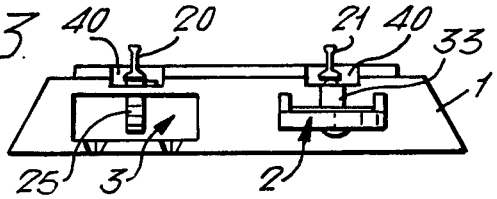
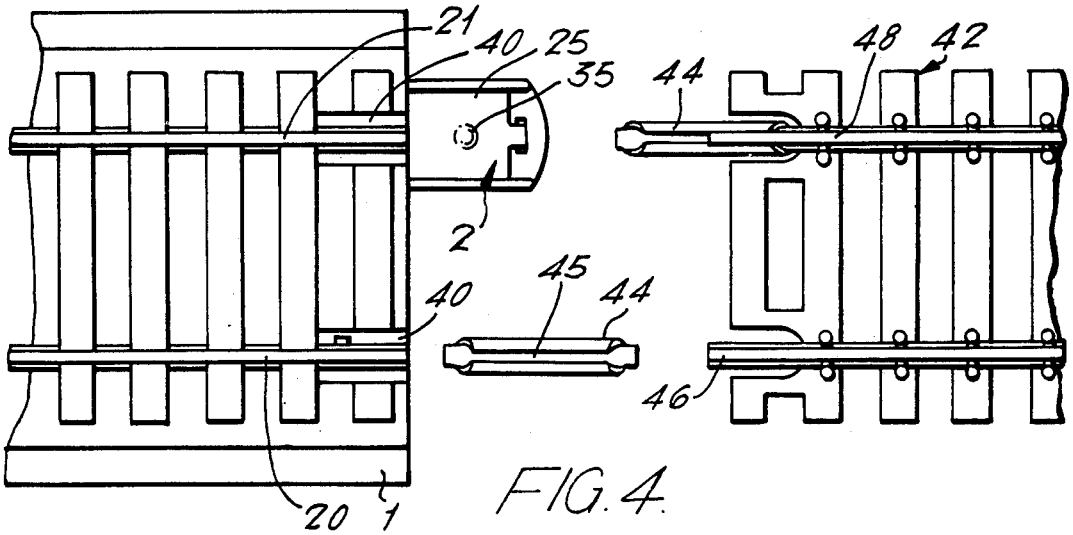
FIG. 4.

CONNECTION DEVICE FOR TOY VEHICLE TRACKS

The present invention relates to tracks for toy vehicles such as railway trains and constitutes a Continuation in Part of my application Ser. No. 807,102 of July, 16, 1977, now abandoned.

Various connections have been designed in the past for joining sections of track for toy vehicles. Frequently these suffer from one or both disadvantages which are that protruding metal connections, primarily intended for electrical conduction are sharp and can hurt children using the track, or else the connections fail to provide a firm join when the track sections are fitted together. This latter disadvantage causes snags in the track making the movement of vehicles along the track difficult and when the rails of the tracks are used as electrical conductors in the case of toy railway tracks, poor electrical connection between track sections results.

Accordingly, the invention provides a plurality of toy vehicle track sections, each having at one or both ends of each track section, a protruding plug portion of plastics material and socket, the socket being adapted to receive a similar plug portion on the next track section, and the plug portion fitting into a similar socket on the next track section, the plug portion or socket having a detent, and the socket or plug portion correspondingly having a detent receiving means for locking engagement with the detent.

In one preferred embodiment of the invention, the socket is provided with a resilient seating, on which the detent or detent receiving means is provided. Preferably, the resilient seating is formed as part of a lower wall of the socket separated from the other walls of the socket at least part of its length by longitudinal slots running substantially in the longitudinal direction of a said track section. In the embodiment of the invention as described, the resilient seating is provided with a hole, forming the detent receiving means.

Preferably, the plug portion is formed with a channel-shaped cross-section with two vertical short portions and a longer horizontal joining portion, on an outer face of which is provided the detent or detent receiving means. The detent may be formed as a round projecting member suitably dimensioned to fit into a round hole or recess in one wall of the socket.

In the case where the track sections are provided with electrical conducting rails, the socket may be provided with an electrical connection, secured to one wall of the socket, and the plug portion is suitably provided with a further electrical connection mounted within the channel. Both electrical connections preferably extend under the conductor rails, and are held in electrical connection with the rails by being sandwiched between a track base and the rails.

It has not hitherto been convenient to connect together a track section of the type described and a standard track section in which the rails are connected together end to end by fishplates which are pushed over the end of a rail of one section and over the end of a corresponding rail of an adjacent track section and which then act to connect together both the rails and tracks.

A track section in accordance with this invention may have its base cut away beneath the ends of the rails at one or both ends so that a fishplate can be received beneath the rail to connect this to the rail of a standard track section. Thus a track section in accordance with the present invention can either be connected to another track section of the type described or alternatively it can be connected to a standard track section using standard fishplates.

Preferably each socket and/or plug is connected to a rail carried by the track section by means of a resilient or spring electrical connecting element which extends up across the cut away portion of the base of the section to engage the underside of the end of the respective rail. The necessary electrical connection is thus maintained between the plugs and sockets of the corresponding rails when a track section in accordance with this invention is connected to another track section of the type described.

The invention will now be described with reference to the accompanying drawings, in which:

FIG. 1 is a perspective end view of one track section according to the invention, FIG. 2 is an underside plan view of the track section shown in FIG. 1, FIG. 3 is an end elevation of a modification of the track section;

FIG. 4 is a view of the end of a track section in accordance with this invention and a standard rail track section just prior to engagement; and FIG. 5 is a view corresponding to FIG. 4 showing the track sections engaged together.

As shown in the drawings, at the end of each track section 1 there is provided a protruding plug portion 2 formed of plastics material. There is also provided a socket 3 formed in a base 4.

The socket 3 is formed with a rectangular cross-section, having four walls. The lower wall 5 is provided with a resilient seating 6 in which is formed a hole 7. On either side of the resilient seating longitudinal slots 8 and 9 are provided to allow some independent movement of the seating 6 from the remainder of the lower wall 5.

The protruding plug portion 2 is formed into a channel shape having two short vertical portions 10 and 11 interconnected by horizontal portion 12 formed with a slight curvature on its leading edge 13. The plug portion 2 is dimensioned so as to fit precisely into the socket 3 and on the lower exterior side 14 of the plug portion there is provided a detent 15 which protrudes from the surface 14 to fit into a hole 7 in the seating 6 of the next track section.

Whereas the track sections are primarily designed for use with electrically operated toy vehicles, particularly railway trains, the connections provide a firm and suitable joint for non-electrical track. In the event of the track being electrified, metal conductor rails 20 and 21 are provided which are slotted into slots 22 provided in each sleeper 23 and crimped at, for example 24, between two sleepers 23 in order to provide a stop to longitudinal movement after assembly.

An electrical connection 25 is provided in the socket which is located by two slots (not shown) in the upper wall of the socket, so as to pass under and maintain contact with rails 20. In the plug portion 2 a corresponding connection is provided by means of a plate 27 held to the interior upper surface 28 of the portion 12 by means of a turned-over lip 29 engaging in a slot 30 and recess 31. The connector 27 is held to the rail 21 by passing through a slot 32 under the rail 21 so that an extension portion 33 is sandwiched between the track base 4 and the rails 21, to make contact at its terminal with a portion 34 of the rail 21. The connection plate 27 is provided with an upwardly protruding portion 35 to ensure a good contact with the next track section connector 25.

It will be appreciated that great care has been taken to ensure that all metal portions extending beyond the end 36 of each track section are guarded by means of the protruding plug portion 2. No metal connections in the socket portion extend beyond the end 36 of the track section.

In the modification illustrated in FIGS. 3–5 the base portion 1 of the track section is cut away as illustrated at 40 beneath each end of each rail 20, 21 so that, in effect, the free ends of the rail overhang the base at their terminal portions and as can be seen in FIG. 3 the connecting elements 25, 33 extend up across the cut away portion 40 to resiliently engage the underside of the respective rails and to maintain a good electrical contact.

If the track illustrated in FIGS. 3–5 is to be connected to a standard track such as is generally shown at 42 in FIGS. 4 and 5 then fishplates 44 are slid over the ends of the rails 46, 48 of the standard track section 42 and over the rails 20, 21 of the track section in accordance with this invention; the cut away portion 40 enabling the fishplate to be slid beneath the ends of the rails 20 and 21. When the fishplates are slid into cutouts 40 beneath rails 20, 21 they resiliently deflect connecting elements 25, 33 downwardly. Upon the removal of the fishplates from cutouts 40 the connecting elements 25, 33 again resiliently engage the underside of the rails.

The fishplates 44 as can be seen in FIG. 4 comprise a bent tubular metal sleeve open at both ends and formed with a longitudinal slot 45 to enable the side wall portions to be sprung apart when inserted over the ends of rails and then tightly to grip the rails.

The connected tracks are shown in FIG. 5 and it will be appreciated that a good mechanical joint is achieved due to the use of the fishplates which also act electrically to connect the rails 20 and 46; and 21 and 48.

What we claim is:

1. A toy railroad track section comprising:

(a) an elongate base formed of molded plastic material, (b) a pair of spaced electrically conductive rails along which the toy is to run, the rails being attached to and supported by the base, and extending along the base from one end to the other end thereof, (c) a protruding plug and a socket integrally formed with the base at each end of the base, the plug and the socket being so shaped, dimensioned and positioned that when two track sections are joined together, the plug of one section fits in the socket of the adjacent section, (d) each plug having a channel-shaped cross-section defined by two upright side portions having lower ends and a horizontal portion having an underside and an upper side forming the lower ends of the side portions, (e) a projecting detent integrally formed with the plug and projecting downwardly from the underside of the horizontal portion, (f) an electrically conductive plate positioned adjacent the upper side of the horizontal portion and fitting within the upright side portions and the length of the plug, (g) means electrically connecting the conductive plate with one of said rails, (h) each of the sockets being defined by upper and lower horizontally extending walls and upright side walls of the base and forming a recess for receiving a plug of another track section for joining two such sections to each other, (i) a pair of spaced slots extending partway along the lower horizontally extending wall of the socket so as to define a resilient portion of the lower wall, (j) a cut-out in the resilient portion positioned to receive the detent of the plug, the detent being shaped and arranged to resiliently deform the resilient portion as two track sections are being joined until the detent enters the cut-out, to thereby enable a mechanical interlocking of two track sections, and (k) a resilient electrically conductive strip electrically connected to one of the rails and extending downwardly across each socket, whereby when two track sections are joined together, the strip contacts the plate of the plug fitted into the socket.

2. A track section as claimed in claim 1 wherein the detent is formed as a round projecting member, wherein the cutout is formed as a round hole dimensioned so as to receive the round member within the hole.

3. A track section as claimed in claim 1 wherein the means electrically connecting the plate and the strip each include a portion extending under a corresponding one of the conductive rails, and are held in electrical connection with the rails by being sandwiched between the base and the rails.

4. A track section according to claim 1, wherein the means electrically connecting the conductive plate with one of the rails includes first means for resiliently engaging the rail, wherein the resilient electrically conductive strip includes second means for resiliently engaging the other of the rails, and wherein the base includes a cutout beneath ends of the rails dimensioned and arranged so that the ends of the rails extend over the cutouts for providing space for receiving a fishplate, whereby the first and second means for resiliently electrically connecting can be resiliently moved out of contact with their respective rails when fishplates are received in the cutouts beneath the ends of the rails.

5. A toy railroad track section for end-to-end connection with another, adjoining track section for forming a continuous toy railroad track, the section comprising: an elongate plastic base; a pair of spaced apart, electrically conductive rails attached to and supported by the base and extending over the length thereof from one end of the base to another end thereof; and connector means for securely mechanically interlocking adjacent track sections and for forming an electric connection between respective tracks on the sections, the connector means including an aperture formed in each end of the base and extending generally in the direction of the track section, the aperture being defined by walls of the base which completely surround at least a portion of the cross-section of the aperture proximate the corresponding end of the base; an electrically conductive strip constructed of a resilient material, a first portion of the strip being attached to the base and a second portion of the strip extending generally in the direction of the aperture and protruding into the cross-section thereof, the second portion being disposed entirely within the aperture so as to protect it from accidental contact and damage; means for establishing an electrical connection between the strip and the associated track attached to the base; a relatively rigid plug projecting from each end of the base, the plug being dimensioned to snugly fit into a corresponding aperture of an adjoining track section, the plug having a length adapted to be received within the aperture and including a depression located to be in substantial alignment with the second portion of the conductive strip protruding into the corresponding aperture cross-section of the adjoining track section, the depression being defined by a base member of the plug so that the plug can be slidably inserted into the aperture and the base member can resiliently deflect the second portion of the conductive strip if the two come in contact with each other; an electrically conductive plate disposed within the depression carried by the base member; the base member and the plate having a combined thickness so that the latter contacts and resiliently deflects the second portion of the conductive strip when the plug is inserted into the aperture; means attaching the plate to the base of the track section; and means for electrically connecting the plate with the corresponding track of the section; whereby the insertion of the plug in a corresponding aperture of the adjoining track section simultaneously causes a secure interlocking of the plug and the walls defining the aperture cross-section and, therewith of the adjoining track sections, and the establishment of an electric connection between corresponding tracks of adjoining sections via the plates and the strips.

6. A toy railroad section for the end-to-end connection with another, adjoining track section for forming a continuous toy railroad track, the section comprising:

an elongate plastic base;

a pair of spaced apart, electrically conductive rails attached to and supported by the base and extending over the length thereof from one end of the base to another end thereof; the base including adjacent its ends and beneath the respective rails depression dimensioned and arranged so that the ends of the rails extend over the depression to provide space for receiving a fishplate;

and connector means for securely mechanically interlocking adjacent track sections and for forming an electric connection between respective rails on the sections, the connector means including (a) an aperture formed in each end of the base and defined by integrally constructed upper and lower, generally horizontally disposed walls and upright side walls interconnecting the horizontal walls to give the aperture a fully defined cross-section, the aperture extending from the corresponding end of the base towards the other end thereof;

(b) a pair of spaced slots in the portion of each base defining an aperture, each pair of slots being arranged to separate a portion of the associated lower wall from the adjoining upright walls so as to render such portion of the lower wall resiliently deformable;

(c) a cutout in the resilient portion of each lower wall;

(d) a resilient, electrically conductive strip attached to each of the base and having a deflectable portion wholly disposed within the aperture at the corresponding base end, the deflectable portion extending generally in the direction of the aperture and into the cross-section thereof so as to define a free end of such deflectable portion which is spaced from the portion of the base to which the strip is attached;

(e) a plug protruding from each end of the base for insertion into an aperture in the adjoining track section, the plug having a generally U-shaped profile defined by spaced apart upright side portions and a base member interconnecting ends of the side portions, the side portions having outer surfaces spaced apart to be snugly received by the upright side walls of the aperture, the profile of the plug further defining a recess positioned and oriented so as to receive the deflectable portion of the strip when the plug is inserted into an aperture;

(f) a detent projecting from a side of the base member facing away from the recess, the detent being positioned and formed to be received within the cutout when the plug is inserted into the aperture and to engage and resiliently deflect the resilient portion of the lower wall when the plug is disposed within the aperture and the detent is outside the cutout;

(g) an electrically conductive plate carried by the base member and disposed within the recess of the plug, the base member and the plate having a combined thickness so as to engage and deflect the free end of the deflectable strip portion to thereby establish an electric connection between the strip and the plate;

whereby the insertion of the plug in an aperture of the adjoining track section initially causes the resilient deflection of the resilient lower wall portion and thereafter causes a snap-in engagement between the detent and the cutout to thereby mechanically interlock the track sections and simultaneously establish an electric connection between the strip and the plate;

(h) first means electrically coupled to the plates and at least partially disposed within the depression in the base for beneath one of the rails resiliently contacting the corresponding rail to electrically couple the plate with such rail;

(i) second means electrically coupled with the strip and at least partially disposed within the depression beneath the other one of the rails for resiliently contacting the other rail to electrically couple the strip with such other rail;

whereby the adjoining track sections can be mechanically and electrically coupled by inserting corresponding plugs of the sections and corresponding apertures thereof; and whereby the track section can further be coupled with another track element having interconnected rails but being devoid of plugs and apertures by slipping fishplates in the depressions to engage the rails overlying the depressions and engaging with such fishplates the rails of the other track element.

* * * * *